United States Patent [19]

Yoshida et al.

[11] Patent Number: 4,590,648

[45] Date of Patent: May 27, 1986

[54] SLIDER FOR SLIDE FASTENER

[75] Inventors: Hiroshi Yoshida; Susumu Ishii, both of Kurobe, Japan

[73] Assignee: Yoshida Kogyo K. K., Tokyo, Japan

[21] Appl. No.: 603,747

[22] Filed: Apr. 25, 1984

[30] Foreign Application Priority Data

May 7, 1983 [JP] Japan ..... 58-68212[U]

[51] Int. Cl.[4] ..... A44B 19/26

[52] U.S. Cl. ..... 24/415; 24/426; 24/428

[58] Field of Search ..... 24/415, 416, 417, 426, 24/427, 428, 430

[56] References Cited

U.S. PATENT DOCUMENTS

| | | | |
|---|---|---|---|
| 2,078,745 | 4/1937 | Ulrich | 24/415 |
| 2,092,538 | 9/1937 | Sundback | 24/428 |
| 2,575,501 | 11/1951 | Ulrich | 24/428 |
| 3,968,545 | 7/1976 | Kawashima | 24/426 |

FOREIGN PATENT DOCUMENTS

| | | | |
|---|---|---|---|
| 678594 | 9/1952 | United Kingdom | 24/415 |
| 945754 | 1/1964 | United Kingdom | 24/427 |

*Primary Examiner*—William E. Lyddane
*Assistant Examiner*—Peter A. Aschenbrenner
*Attorney, Agent, or Firm*—Hill, Van Santen, Steadman & Simpson

[57] ABSTRACT

A slide fastener slider includes a pair of parallel spaced wings each having a generally W-shaped front edge extending between a pair of flanges extending along the opposite lateral edges of the wing across a neck interconnecting the wings to define therebetween a substantially Y-shaped guide channel. The front edge has a pair of outer portions respectively disposed adjacent to the flanges and projecting forwardly beyond a pair of planes extending respectively between a front end of the neck and respective front ends of the flanges. Each of the wings has a pair of sloped interior guide surfaces extending respectively along the outer portions of the front edge and facing forwardly of a slider body of the slider. When a pair of rows of coupling elements is introduced into the guide channel in a tilted condition, the tilted individual coupling elements are substantially brought back into their normal position as their leg portions slide along the sloped guide surfaces on one of the wings prior to arrival to their coupling heads at the front edge of the other wing.

8 Claims, 6 Drawing Figures

SLIDER FOR SLIDE FASTENER

BACKGROUND OF THE INVENTION

1. Field of the Invention

The present invention relates generally to slide fastener sliders, and more particularly to a slider which is particularly suitable for a slide fastener having a pair of opposed rows of discrete coupling elements.

2. Prior Art

Slide fastener sliders 10 are known which generally comprise, as shown in FIG. 1 of the accompanying drawings, a slider body 11 including upper and lower wings 12, 13 joined at their front end by a neck 14 so as to define therebetween a substantially Y-shaped guide channel 15 for the passage therethrough of a pair of opposed rows of coupling elements (not shown) of the slide fastener. Each of the wings 12, 13 has a pair of flanges 16 extending along opposite lateral edges thereof to define a portion of the guide channel 15, and a front edge 17 extending substantially arcuately between the flanges 16 across the neck 14. When the opposed rows of coupling elements are taken into mutual engagement by the slider 10 to close the slide fastener, they are likely to tilt with respect to the general plane of slide fastener stringer tapes. Such tilted coupling elements successively impinge at their respective coupling heads against the arcuate front edge 17 of one of the wings 12, 13 before their respective leg portions are introduced into the guide channel 15. Thus, the slider 10 is prevented from sliding smoothly along the rows of coupling elements and is likely to damage the latter during repeated opening and closing operations of the slide fastener.

SUMMARY OF THE INVENTION

It is therefore an object of the present invention to provide a slide fastener slider capable of sliding smoothly along a pair of opposed rows of coupling elements, even when the coupling elements are tilted with respect to the general plane of slide fastener stringer tapes.

According to the present invention, a slider body of a slide fastener slider includes a pair of paralled spaced wings each having a generally W-shaped front edge extending between opposite lateral edges of the wing across a neck interconnecting the wings to define therebetween a substantially Y-shaped guide channel. The front edge has a pair of outer portions respectively disposed adjacent to the opposite lateral edges and projecting forwardly beyond a pair of planes extending respectively between a front end of the neck and front ends of a pair of flanges extending along the opposite lateral edges of the wing. Each of the wings has a pair of sloped interior guide surfaces extending respectively along the outer portions of the front edge and facing forwardly of the slider body. When a pair of rows of coupling elements is introduced into the guide channel in a tilted condition, the tilted individual coupling elements are substantially brought back into their normal position as their respective leg portions slide along the sloped guide surfaces on one of the wings prior to arrival of their respective coupling heads at the front edge of the other wing. The wing may have a further pair of sloped interior guide surfaces extending respectively along a pair of inner portions of the front edge disposed one on each side of the neck, the further pair of guide surfaces being engageable with the coupling heads to further rectify the position of the coupling elements.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
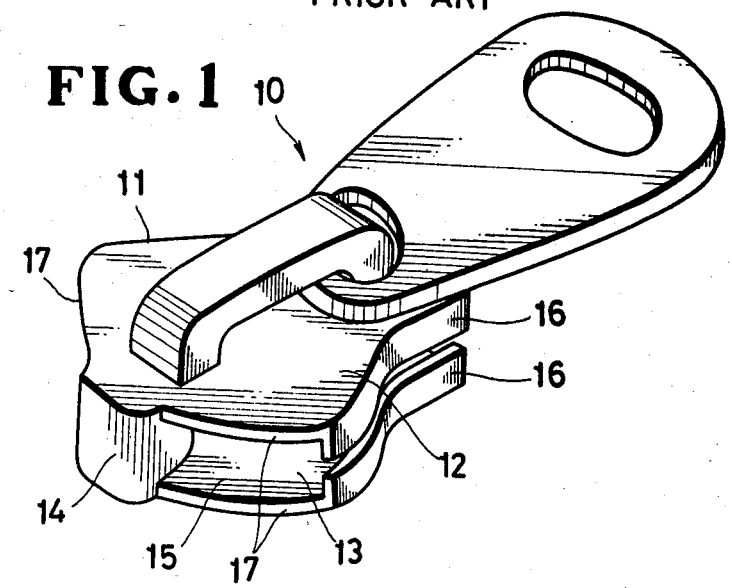
PRIOR ART FIG. 1
FIG. 1 is a perspective view of a known slide fastener slider.
Figure 2:
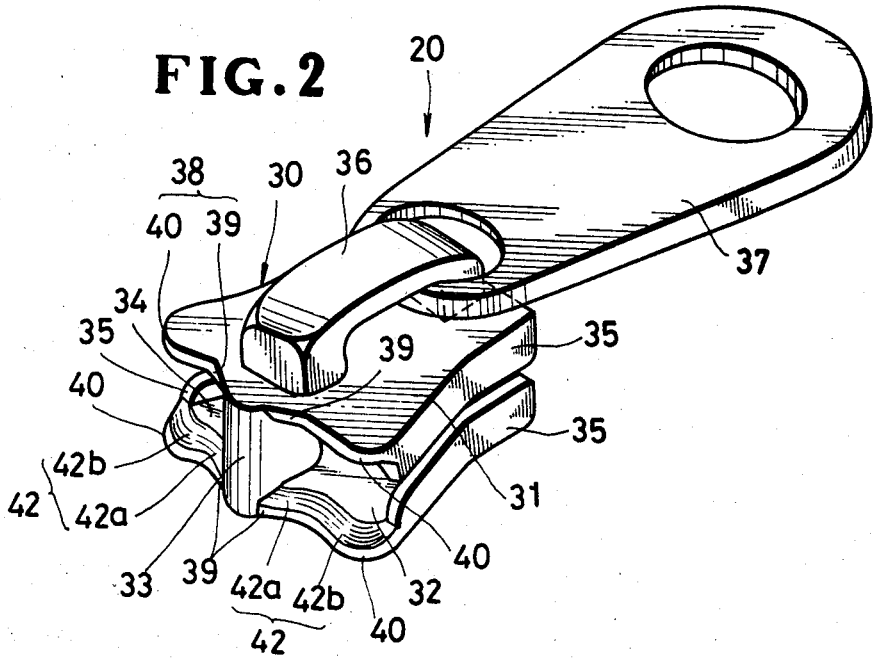
FIG. 2 is a perspective view of a slide fastener slider according to the present invention.

The principles of the present invention are particularly useful when embodied in a slide fastener slider such as shown in FIG. 2, generally indicated by the numeral 20.

Figure 4:
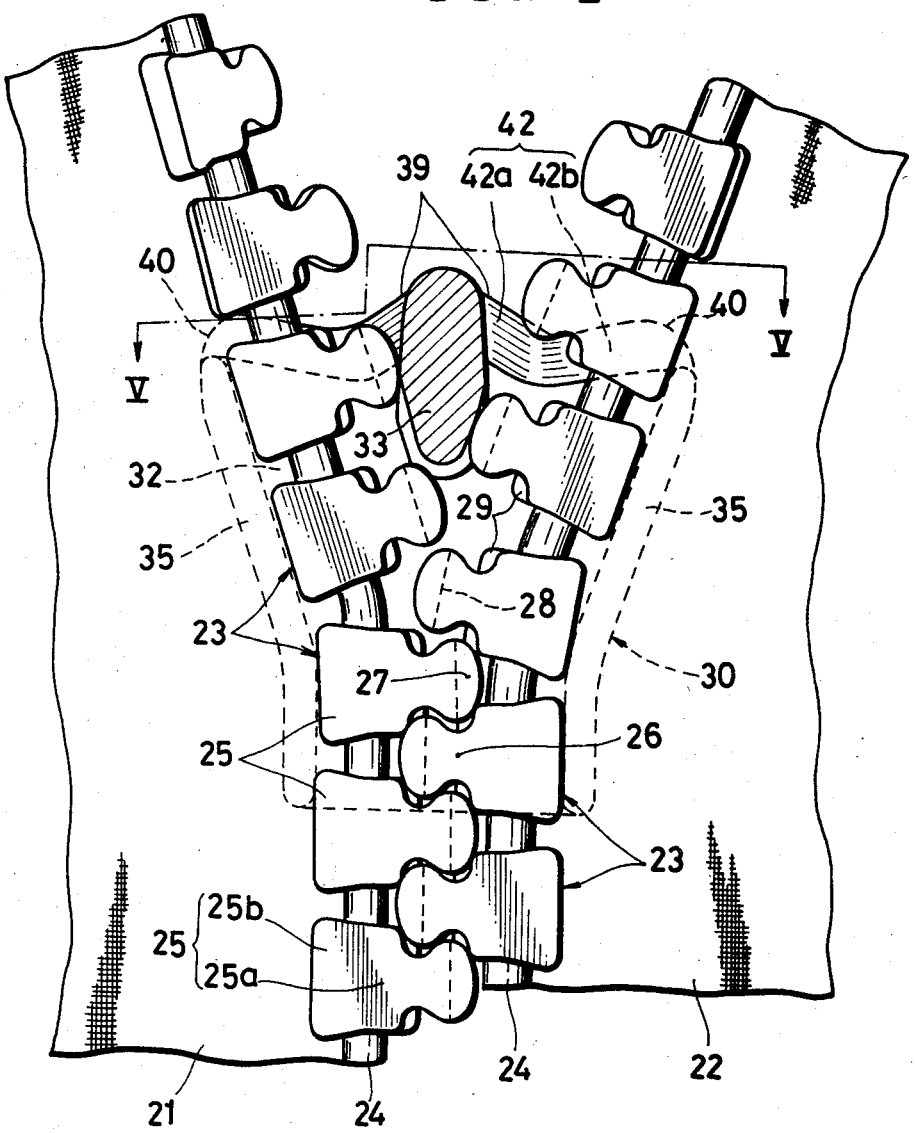
FIG. 4 is a view similar to FIG. 3, showing a pair of fastener stringers threaded through the slider.
Figure 5:
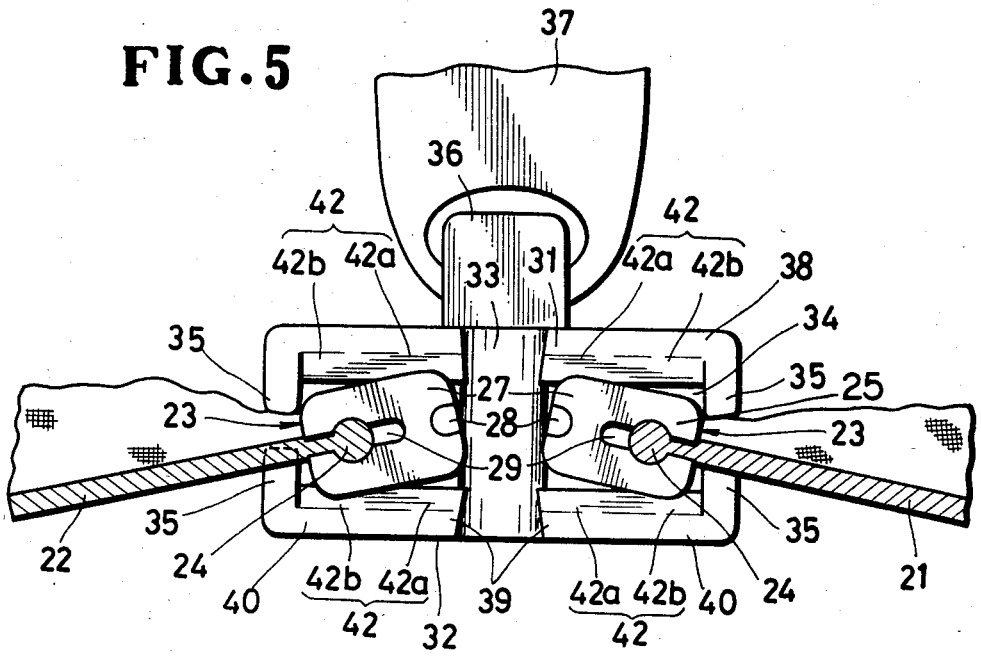
FIG. 5 is a fragmentary cross sectional view taken along line V—V of FIG. 4.

The slider 20 is suitable for a slide fastener which comprises, as shown in FIGS. 4 and 5, a pair of stringer tapes 21, 22 having a pair of opposed rows of discrete coupling elements 23 made of synthetic resin injection-molded on the stringer tapes 21, 22 along opposed inner longitudinal edge portions thereof, each longitudinal edge portion having a reinforced or beaded marginal edge 24. Each of the coupling elements 23 includes a leg portion 25 mounted on the longitudinal edge portion around the respective beaded edge 24, and a coupling end portion projecting beyond the beaded edge 24 transversely of the stringer tape 21, 22 and having a reduced neck 26 and a rounded head 27 integral therewith, the neck 26 and the head 27 being complementary in shape with each other. The head 27 has a recess 28 extending longitudinally of the stringer tape 21, 22 in the general plane of the same and opening away from the leg portion 25. The neck 26 has a pair of wings or projections 29 projecting laterally in opposite directions in the same plane as the recess 28. Each of the leg portions 25 has a first part **25*a* contiguous to the neck 26 and having a uniform width, and a second part 25*b* integral with the first part 25*a* and having a width increasing gradually away from the neck 26, as shown in FIG. 4. When the opposed rows of coupling elements 23 are coupled together, the projections on the neck 26 of one coupling element 23 are received in the recesses 28 in the heads 27 of the adjacent coupling elements 23**.

As shown in FIG. 2, the slider 20 comprises a slider body 30 including a pair of parallel spaced upper and lower wings 31, 32 joined at their front end by a neck or guide post 33 so as to define therebetween a substantially Y-shaped guide channel 34 for the passage therethrough of the opposed rows of coupling elements 23 (FIG. 4). Each of the wings 31, 32 has on its interior side a pair of flanges 35, 35 extending along the opposite lateral edges thereof to define therebetween a portion of the guide channel 34. Each pair of opposed flanges is spaced from one another by a distance slightly larger than the thickness of the stringer tape 21, 22 (FIG. 5) so as to restrict tilting of the coupling elements 23. The body 30 also includes an arch-shaped lug 36 disposed on the top surface of the upper wing 31, and a pull tab 37 pivotably connected to the lug 36 for manipulating the slider 20.

Figure 3:
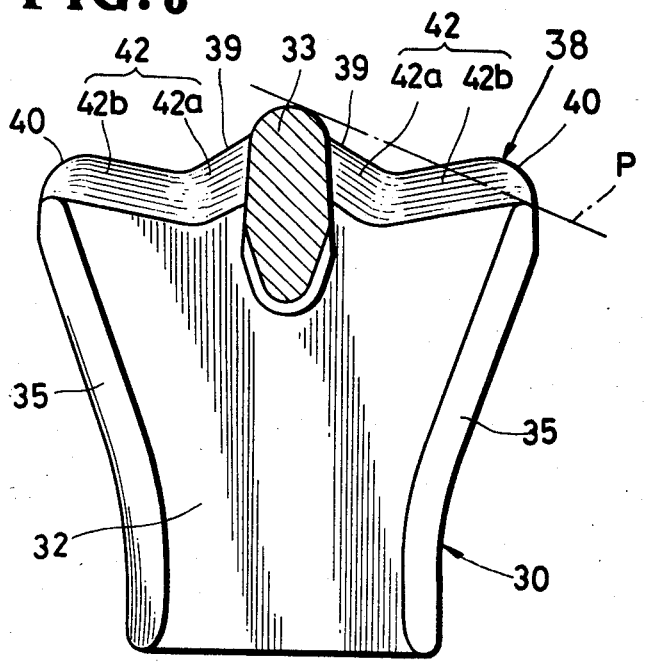
FIG. 3 is an enlarged plan view, partly in cross section, of the slider of FIG. 2 with an upper wing omitted.

As better shown in FIG. 3, each of the wings 32 (only the lower wing being illustrated) has a generally W-shaped front edge 38 extending between the opposite flanges 35, 35 across the guide post 33. The front edge 38 has a pair of opposite inner portions 39, 39 adjacent to the guide post 33, and a pair of opposite outer portions 40, 40 adjacent to the flanges 35, 35, respectively. Each of the inner portions 39, 39 terminates short of a plane P extending between the front end of the guide post 33 and a corresponding one of the flanges 35, while each of the outer portions 40, 40 projects forwardly beyond the plane P. The wing 32 has a pair of sloped interior guide surfaces 42, 42 each extending along the length of a corresponding pair of the inner and outer front edge portions 39, 40 and facing forwardly outwardly of the slider body 30. Each of the guide surfaces 42, 42 has an inner portion 42*a* extending along the inner front edge portion 39, and an outer portion 42*b* extending along the outer front edge portion 40, the inner and outer portions 42*a*, 42*b* having substantially the same width (i.e. as measured perpendicularly to the edge of each said portion) and sloping at the same ramp or camming angle, preferably between 25 to 30 degrees. Alternatively, the inner portion 42*a* may be different in said width than the outer portion 42*b* and hence if narrower would have an angle of inclination which would have the same ramp or camming distance in a shorter width and hence such angle would be greater than that of the outer portion 42*b* so as to accomodate an amount of tilting of the coupling head 27 which is greater than that of the leg portion 25 (FIG. 5).

With the slider 20 thus constructed, sliding movement of the slider 20 in a direction to close the slide fastener causes the leg portion 25 of each coupling element 23 to come to the respective pair of opposed outer portions 40 of the wings' front edges 38 prior to arrival of the coupling head 27 at the inner portions 39 of the front edges 38. When the opposed rows of coupling elements 23 are introduced into the guide channel 34 in a tilted condition as shown in FIG. 5, the leg portions 25 are brought into engagement with the outer portions 42*b* of the sloped guide surfaces 42 of the lower wing 32. As the leg portions 25 slide along the outer portions 42*b*, the coupling heads 27 angularly move toward the lower wing 32. Continuous movement of the slider 20 causes the coupling heads 27 to slide along the inner portions 42*a* of the guide surfaces 42 of the upper wings 31, thereby further rectifying the position of the coupling elements 23.

With the slider 20 having the W-shaped front edge 38 and the sloped guide surfaces 42, the opposed rows of coupling elements 23 are smoothly introduced into the slider's guide channel 34 without impinging against the front edges 38 of the wings 31, 32 even when they are tilted with respect to the general plane of the stringer tapes 21, 22. Thus, smooth sliding movement of the slider 20 can be achieved.

Figure 6:
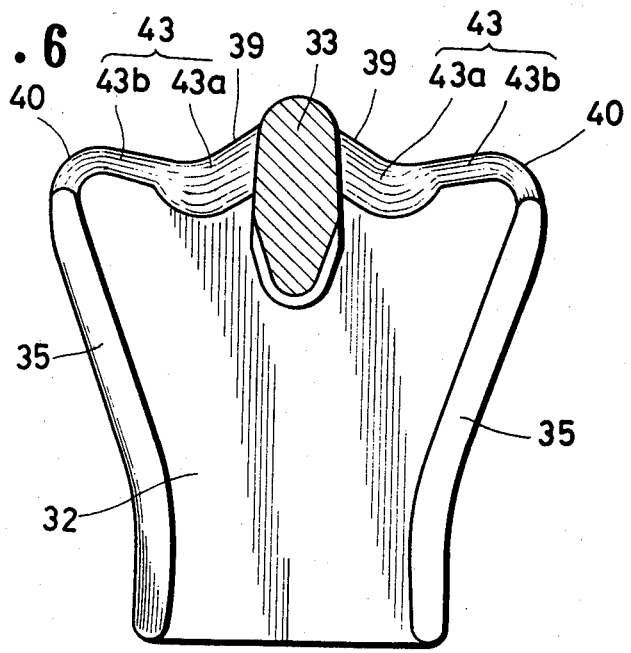
FIG. 6, appearing with FIG. 3, is a view similar to FIG. 3, showing another embodiment.

A modified slide fastener slider, only a lower portion of which is shown in FIG. 6, is substantially the same as the slider shown in FIGS. 2–5, with the exception that each of sloping interior guide surfaces 43 has a wider varying or non-uniform width. An inner portion 43*a* of the guide surface 43 which extends along the inner front edge portion 39, is wider than an outer portion 43*b* extending along the outer front edge portion 40. Thus, the outer guide portion 43*b* has an angle of inclination greater than that of the inner guide portion 43*a* since it makes the same camming rise in a shorter distance. With the slider having such guide surfaces 43, the individual coupling elements are rapidly restored into their normal position as they slide along the narrow, steep sloped outer guide portions 43*b*. An additional rectification of the position of the coupling elements is achieved as the coupling heads slide along the wide, gentle sloped inner guide portions 43*a*.

The slider constructed in accordance with the present invention also performs satisfactorily when it is used in slide fasteners having a pair of opposed rows of continuous coiled or zigzag coupling elements.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A slider for a slide fastener including a pair of stringer tapes carrying along their inner longitudinal edges a pair of rows of coupling elements, each coupling element having a leg portion mounted on the longitudinal edge and a coupling head projecting beyond the longitudinal edge transversely of the stringer tape, said slider comprising:

(a) a slider body including a pair of parallel spaced wings joined at their front end by a neck so as to define therebetween a substantially Y-shaped guide channel for the passage of the rows of coupling elements, at least one of said wings having a pair of flanges projecting from opposite lateral edges thereof toward the other wing and defining therebetween a portion of said guide channel;

(b) each of said wings having a front overlying each other, the edges thereof being coextensive relative to each other and extending between said opposite lateral edges thereof across said neck, each said front edge having a pair of outer portions respectively disposed adjacent to said opposite lateral edges and projecting forwardly beyond a pair of planes extending respectively between a front end of said neck and respective front ends of said flanges; and (c) each of said wings having a pair of sloped interior guide surfaces extending respectively along each said outer portions of said front edge and facing forwardly of said slider body, said guide surfaces being engageable with the leg portions of the coupling elements.

2. A slider according to claim 1, each said front edge further having a pair of inner portions disposed one on each side of said neck, each said inner portion terminating short of a corresponding one of said planes, each of said wings having a further pair of sloped guide surfaces extending respectively along said inner portions of said front edge and facing forwardly of said slider body, said further pair of guide surfaces being engageable with the coupling heads of the coupling elements.

3. A slider according to claim 2, said front edge having a generally W-shape, the two V-portions of said W-shape opening forwardly.

4. A slider according to claim 2, said pair of guide surfaces and said further pair of guide surfaces having the same camming width and sloping at the same angle.

5. A slider according to claim 4, said pair of guide surfaces and said further pair of guide surfaces sloping at a camming angle between 25 degrees and 30 degrees.

6. A slider for a slide fastener including a pair of stringer tapes carrying along their inner longitudinal edges a pair of rows of coupling elements, each coupling element having a leg portion mounted on the longitudinal edge and a coupling head projecting beyond the longitudinal edge transversely of the stringer tape, said slider comprising:

(a) a slider body including a pair of parallel spaced wings joined at their front end by a neck so as to define therebetween a substantially Y-shaped guide channel for the passage of the rows of coupling elements, at least one of said wings having a pair of flanges projecting from opposite lateral edges thereof toward the other wing and defining therebetween a portion of said guide channel;

(b) each of said wings having a front edge extending between said opposite lateral edges thereof across said neck, said front edge having a pair of outer portions respectively disposed adjacent to said opposite lateral edges and projecting forwardly beyond a pair of planes extending respectively between a front end of said neck and respective front ends of said flanges;

(c) each of said wings having a pair of sloped interior guide surfaces extending respectively along said outer portions of said front edge and facing forwardly of said slider body, said guide surfaces being engageable with the leg portions of the coupling elements;

(d) said front edge further having a pair of inner portions disposed one on each side of said neck, each said inner portion terminating short of a corresponding one of said planes, each of said wings having a further pair of sloped guide surfaces extending respectively along said inner portions of said front edge and facing forwardly of said slider body, said further pair of guide surfaces being engageable with the coupling heads of the coupling elements; and (e) said pair of guide surfaces and said further pair of guide surfaces having different widths and sloping at different camming angles.

7. A slider according to claim 6, said pair of guide surfaces being narrower than said further pair of guide surfaces and sloping at a camming angle greater than the angle of inclination of said further pair of guide surfaces.

8. A slider according to claim 6, said further pair of guide surfaces being narrower than said pair of guide surfaces and sloping at a camming angle greater than the angle of inclination of said pair of guide surfaces.

* * * * *